United States Patent [19]

Stobb

[11] 4,111,310

[45] Sep. 5, 1978

[54] SIGNATURE BUNDLE HOIST CLAMP WITH PIVOT

[76] Inventor: Walter John Stobb, R.D. 1, Box 60, Pittstown, N.J. 08867

[21] Appl. No.: 790,314

[22] Filed: Apr. 25, 1977

[51] Int. Cl.[2] ..... B65G 7/00

[52] U.S. Cl. ..... 214/1 QD; 294/86 R

[58] Field of Search ..... 214/1 Q, 1 QD, 1 R, 214/130 R; 294/86 R, 88

[56] References Cited

U.S. PATENT DOCUMENTS

| | | | |
|---|---|---|---|
| 2,390,293 | 12/1945 | Colson | 294/86 R |
| 2,703,252 | 3/1955 | Blackwell | 214/1 QD X |
| 3,825,134 | 7/1974 | Stobb | 271/215 X |
| 3,842,989 | 10/1974 | Nakamura | 214/1 QD |

FOREIGN PATENT DOCUMENTS

| | | | |
|---|---|---|---|
| 40,741 | 1/1969 | Finland | 214/1 QD |
| 822,062 | 11/1951 | Fed. Rep. of Germany | 214/1 QD |

*Primary Examiner*—Frank E. Werner

*Attorney, Agent, or Firm*—Arthur J. Hansmann

[57] ABSTRACT

A signature bundle hoist clamp with a pivot for rotating the bundle about its longitudinal axis to thereby selectively position the folds in the signature at either the top or bottom of the bundle, for instance. The clamp includes adjustable legs, and a bearing plate is rotatable on each of the legs and is presented toward the bundle for compressing the bundle and permitting the rotation mentioned. A combined thrust and radial bearing is interposed between the clamp legs and the bearing plate for the compression and rotation mentioned, and a releasable stop pin engages the bearing plate for positioning the bundle in the selected position mentioned. The entire assembly is arranged with a hoist.

5 Claims, 2 Drawing Figures

SIGNATURE BUNDLE HOIST CLAMP WITH PIVOT

This invention relates to a signature bundle hoist clamp with pivot, and, more particularly, it relates to a clamp for holding a lifting a bundle of signatures which are used in the graphic arts industry.

BACKGROUND OF THE INVENTION

The prior art is already aware of bundle clamps and other means for compressing and holding and lifting bundles of signatures which are arranged with folds therein. These clamps or like devices are commonly employed in the graphic arts industry for lifting bundles and transporting them from one location to another in a printing plant or the like, such as moving the bundles from signature stacker apparatus to signature feeder apparatus where the bundle is separated into its individual signatures and collated into a book or magazine. That is, the stacker apparatus of the prior art normally receives folded sheets or signatures and arranges them in a bundle or stack. End boards or like supports or stiffeners are commonly arranged at opposite ends of the stack, and the stack may be strapped or tied to retain it in a secure and discrete condition. Subsequently, it is desired that the bundle or stack be transported to a feeder apparatus where the bundle is taken apart and the individual signatures or sheets are removed from the bundle for assembly or collating into a book or magazine. However, the stacker has formed the stack or bundle of sheets with the folded edges along one side of the stack, and it may be that the feeder apparatus requires that the folded edges be positioned in an orientation different from that which is presented by the usual hoist or lift truck or like transport apparatus of the prior art. Accordingly, it is necessary that the bundle be rotated so that the folded edges are in the required orientation at the feeder device.

Accordingly, it is an object of this invention to provide apparatus which readily and easily permits the proper orientation of a bundle of signatures at a feeder device or like apparatus or other station located in the printing plant or the like. In accomplishing this objective, the present invention utilizes the bundle clamp already employed in the prior art, and the present invention provides apparatus which permits the bundle of signatures to be readily and firmly secured within the clamp and to be rotatable about the longitudinal axis of the bundles for desired and selective positioning of the folds of the signatures in the bundle.

Prior art examples of sheet stacker, transporting, and feeder apparatus are found in U.S. Pat. Nos. 3,739,924 and 3,825,134 and 3,853,234. These three patents also show the use of a stack or bundle clamp for holding the discrete bundle after the formation and for the transport of the bundle, and the first two patents show an adjustable type clamp. Prior art examples of feeder apparatus are found in U.S. Pat. Nos. 3,416,679 and 3,501,139 and 3,982,749, and these three patents show the apparatus receiving and handling the bundle of sheets to separate the sheets into their individual arrangements and pass them to the feeder or like apparatus. In those instances, the orientation of the fold is of concern, and U.S. Pat. No. 3,501,139 discusses this concern and provides for a particular arrangement for reversing the orientation of the folded edges in the sheets.

Accordingly, the present invention provides an arrangement for a stack or bundle clamp wherein the folded edges can be oriented as desired when they are presented to the feeder or like apparatus.

Other objects and advantages will become apparent upon reading the following description in light of the accompanying drawings.

DETAILED DESCRIPTION OF THE PREFERRED EMBODIMENT

Figure 1:
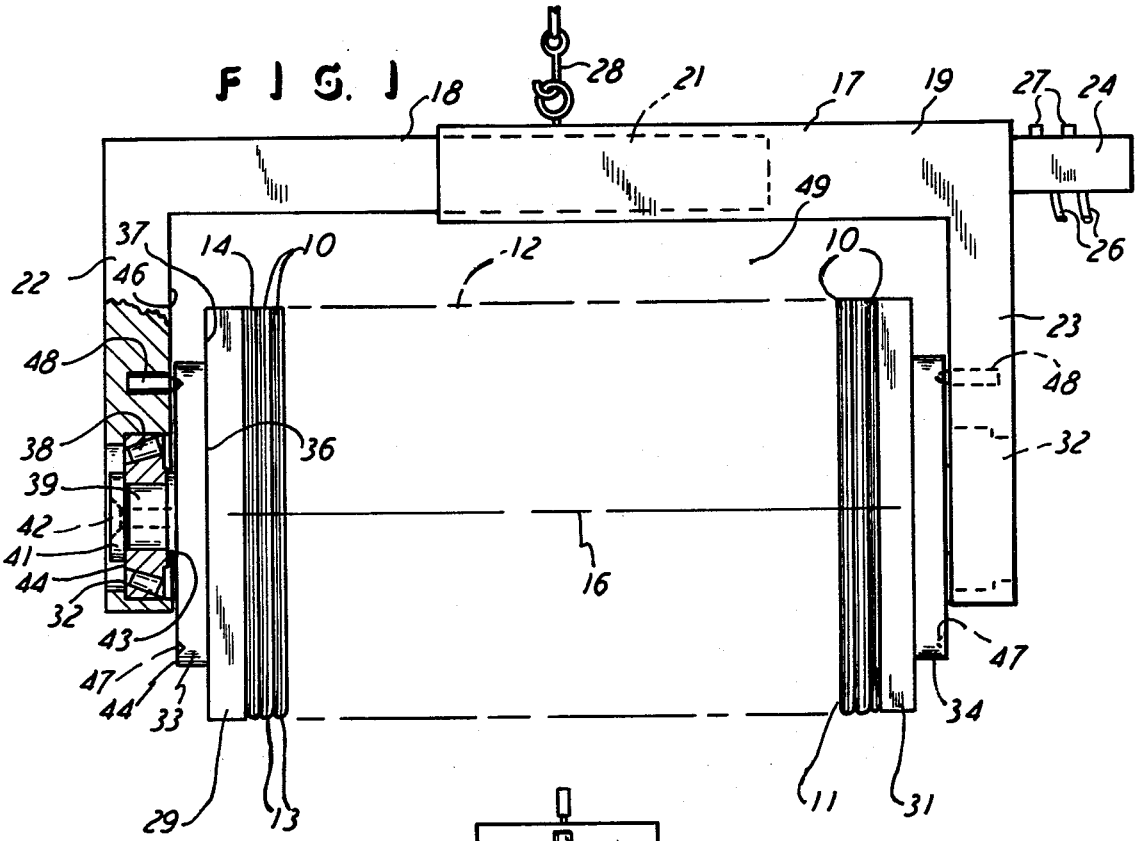
FIG. 1 is a side elevational view of the assembly of the clamp and bundle of this invention.

The drawings show a plurality of sheets or signatures 10 positioned in a stack or bundle designated 11, and it will be understood that the stack or bundle is continuous between the shown end sheets or signatures 10, such as extending through the dot-dash line designated 12. The signatures 10 have folded edges or folds 13 and they have open edges or ends 14, and the folds 13 and edges 14 are on opposite sides of the bundle 11, as shown in FIG. 1 so that the folds 13 are shown on the bottom side of the bundle. It will of course be understood that the stacker apparatus has positioned the signatures 10 in the aligned stack as shown, and it is then desired that the stack be compressed and transported to a sheet feeder or to other locations, as desired. Thus the stack 11 has a longitudinal axis 16 and an adjustable clamp 17 is applied to the stack 11 to compress it endwise along the axis 16. The clamp 17 is shown to be in two sections 18 and 19, and they are telescoped together at the mid-portion designated 21, and the clamp has the usual opposite end legs 22 and 23, and thus it is a C-clamp. It will be understood by one skilled in the art that the clamp 17 is adjustable to be capable of having its legs 22 and 23 moved toward and away from each other to thereby engage, compress, and release, all in sequence, the bundle 11. The C-clamps used for this purpose are arranged in well known manners, such as shown in U.S. Pat. No. 3,739,924, and the clamp 17 is capable of being arranged to securely compress the bundle 11 along its axis 16, and conventional controls, such as the control 24 is associated with the clamp 17 and has electric or pneumatic control lines 26 and control buttons 27, all for the purpose of extending and retracting the C-clamp 17 in any conventional manner, and that portion of the arrangement is well known by anyone skilled in the art. Thus the C clamp 17 is extendable and contractable for the purpose of gripping and securing and releasing the bundle 11, in the manner well understood by anyone skilled in the art. Also, a hoist or crane hook 28, forming a hoist connection with the clamp 17, as shown in FIG. 1, may be employed in connection with the clamp 17 for lifting the assembled bundle 11 in clamp 17 and transporting it to a position desired and also for rotating the bundle 11 about its axis 16 in the manner described hereinafter.

Figure 2:
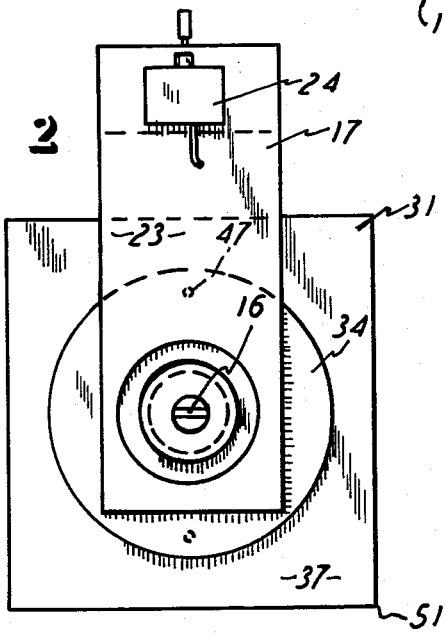
FIG. 2 is an end elevational view of FIG. 1.

The bundle 11 is also shown to be arranged with rectangularly-shaped end boards 29 and 31, and these boards are positioned at opposite ends of the bundle 11, and the folded sheets or signatures 10 are of the same end view size as the boards 29 and 31, as shown in FIG. 2. The clamp legs 22 and 23 are both provided with a combined thrust and axial bearing 32, and the bearings are interposed between the respective clamp legs 22 and 23 and the opposite ends of the bundle 11. Bearing plates 33 and 34 are interposed between each of the two bearings 32 and the two end boards or supports 29 and 31, and these plates 33 and 34 have extended planar surfaces 36 which abut and extend in contact with the outer face or planar surfaces 37 of the respective end boards 29 and 31. Thus the bearing plates 33 and 34 press uniformly and firmly against the end boards 29 and 31 to compress the bundle 11 along its axis 16, and that compression force is presented through the bearings 32 and is resisted by the axial thrust aspects of the bearing 32, such as through the tapered rollers 38 in the bearings 32. Thus, the bearing plates 33 and 34 have hubs 39 which abut the bearings 32 and which extend through the bearings 32 and are secured to the bearings 32 by means of a cap plate 41 and a screw 42, as shown. That is, the hubs 39 have the shoulders 43 which extend over the inner race 44 of the bearing 32 and thus space the bearing plate outer surfaces 44 clear of the clamp leg inner surfaces 46. With this arrangement, the bearing plates 33 and 34 are free to rotate about the longitudinal axes thereof which is coincident with the axis 16 of the bundle 11. As such, the radial aspects of the bearings 32 permit the rotation of the plates 33 and 34, as mentioned, and thus the bundle 11 can be rotated about its axis 16 for positioning the folds 13 in the desired upward or downward direction, according to the requirements of the apparatus handling the bundle 11, such as the aforementioned feeder apparatus.

Accordingly, the bearings 32 are combined thrust and radial bearings and they support the respective plates 33 and 34 for thrust and rotational action relative to the clamp 17, and the plates 33 and 34 are supported clear of the clamp legs 22 and 23 for the rotational action described.

Also, the plates or members 33 and 34 are provided with detents 47 at two diametrically opposite locations on the plate outer surface 44, and the detents 47 are aligned with a detent pin 48 which is retractably mounted in each of the clamp legs 22 and 23 for releasable engagement with a respective one of the detents 47. That is, with the pin 48 engaged with the detent 47 at the upper portion of each plate 33 and 34, as shown in the position in FIG. 1, then the signatures folds 13 are at the bottom of the bundle 11; conversely, when the bearing plates 33 and 34 are rotated to have the diametrically opposite detents 47 engaged by the respective pins 48, then the bundle 11 would be positioned and held in that position to have the folds 13 at the top of the bundle 11. The detent pins 48 may be spring-loaded to be urged toward the respective plates 33 and 34 and thus the pins automatically seat within the detents 47 and are automatically released therefrom, all in accordance with a minimum force of rotation of the bundle 11 about its axis 16. As such, the clamp 17 is provided with the pivot means which incorporates the bearings 32 and the bearing plates 33 and 34.

Therefore, the arrangement is for the side-by-side relationship of the signatures 10 to form the bundle or stack 11 with the end boards 29 and 31 and to compress the bundle along its axis 16 and to render it locatable about that axis by virtue of the pivot mechanism which includes the bearing 32. Also, inter-engaging alignment means in the form of the detent 47 and pin 48 are interposed between the clamp 17 and the bearing plates 33 and 34, all for orientation of the folds in the bundle 11. The plates 33 and 34 are mounted permanently with the bearings 32 which are permanently mounted in the clamp legs 22 and 23.

The common axis of the two bearings 32 is spaced from the C-clamp intermediate portion between the legs 22 and 23 such that the bundle 11 can be rotated about the axis 16 and clear the intermediate C-clamp portion. That is, there is a space 49 between the bundle 11 and the intermediate portion of the C-clamp 17, and the outermost limit of the bundle 11, such as the lower right hand corner 51 in FIG. 2, will be rotatable past the C-clamp intermediate portion, all as provided by the arrangement of the location of the bearings 32 and the size of the bundle 11 and the space 49, as mentioned.

What is claimed is:

1. A signature bundle hoist clamp with pivot, comprising a bundle of signatures stacked in side-by-side arrangement and having signature folds and unfolded edges along opposite sides of the bundle, an end support on each opposite end of the bundle, a C-clamp extending along the bundle and having two legs disposed at respective opposite ends of the bundle and respectively spaced from said supports, a bearing plate disposed in each space between each said leg and each said support and each said plate having a planar surface faced toward the respective said support and in contact therewith, a combined thrust and axial bearing attached with each said bearing plate and interposed between each said leg and each said bearing plate for rotatable support of said bearing plates on said legs and for pressing said supports toward each other and thereby compressing the signatures in the bundle and with said bearings being axially aligned for rotational support of the bundle about its longitudinal axis to thereby provide for turning of the bundle to selectively position the folds of the signatures, interengaging self-releasing alignment means operatively associated with each of said legs and each of said bearing plates for releasably rotationally securing said bearing plates relative to said legs and thereby have said said signatures oriented with the folds and unfolded edges disposed to position the bundle with selectively either the folds or the unfolded edges.

2. The signature bundle hoist clamp with pivot as claimed in claim 1, wherein said means includes a pin and a pin hole arranged to self-engage and self-release upon rotation of said bearing plates.

3. The signature bundle hoist clamp with pivot as claimed in claim 1, including means for lifting said C-clamp to transport and to rotate the bundle.

4. The signature bundle hoist clamp with pivot as claimed in claim 3, wherein said C-clamp includes an adjustable intermediate portion for movement of said legs toward and away from each other.

5. The signature bundle hoist clamp with pivot as claimed in claim 1, wherein said bearings are located on said legs to have the axis of said bearings spaced from the portion of said C-clamp between said legs a distance sufficient to have the outermost limit of the bundle rotatable clear of said C-clamp portion for inverting said bundle on said C-clamp.

* * * * *